United States Patent [19]

Cary

[11] 4,303,813

[45] Dec. 1, 1981

[54] PRECISION ACTUATION SWITCH

[75] Inventor: Paul D. Cary, Fountain Valley, Calif.

[73] Assignee: BASF Aktiengesellschaft, Ludwigshafen, Fed. Rep. of Germany

[21] Appl. No.: 68,952

[22] Filed: Aug. 23, 1979

[51] Int. Cl.[3] ..... H01H 3/16

[52] U.S. Cl. ..... 200/52 R; 200/47; 200/61.13; 200/276; 242/190; 360/74.3

[58] Field of Search ..... 200/61.13, 61.18, 52 R, 200/47, 276, 340; 242/57, 186, 187, 191; 360/74.3; 340/675

[56] References Cited

U.S. PATENT DOCUMENTS

| | | | |
|---|---|---|---|
| 3,924,089 | 12/1975 | Abernethy | 200/276 |
| 3,958,272 | 5/1976 | Rotter et al. | 360/74 |
| 4,023,748 | 5/1977 | Burdorf et al. | 242/192 |

*Primary Examiner*—J. V. Truhe
*Assistant Examiner*—Morris Ginsburg
*Attorney, Agent, or Firm*—Keil & Witherspoon

[57] ABSTRACT

A pair of electrical switches are arranged to be engaged by a respective pivoted carriage member, to indicate the end of tape in correlation with the diameter of a tape reel mounted on each carriage member. Each switch is generally contained within a housing having a longitudinal axis. A pair of electrical contacts, each interconnected to the circuitry of the system, are positioned within the housing adjacent to the axis. A plunger is adapted to be operable along the longitudinal axis between the two contacts and has one end extending from the housing to act as an actuator. A yoke has a base threadedly secured to the plunger and has a body extending parallel with the plunger within the housing. An elastic shorting member is partially compressed and positioned within the body of the yoke. The elastic shorting member is adapted to engage the electrical contacts to conduct electricity through the switch. A compression spring is used to urge the elastic shorting member away from the electrical contacts whereby the switch will be actuated by the position of the plunger which corresponds to a desired position of the respective carriage member.

4 Claims, 4 Drawing Figures

PRECISION ACTUATION SWITCH

BACKGROUND OF INVENTION

The invention relates generally to an electrical switch having a precise actuation position for sensing a position of an engaging member. The invention relates particularly to an electrical switch for sensing when tape is about to end in a reversing video tape recording apparatus. While the particular embodiment of the invention described herein is designed to be utilized in a high-speed reversing video tape recording apparatus, it is to be understood that the present invention may be advantageously utilized in any apparatus wherein it is desirable to precisely sense the position of an engaging movable member.

There are numerous apparatus in which the operation of the apparatus is controlled based upon a position of one or more members of the apparatus. This control is often provided by electric circuitry which is actuated by the member engaging an actuator of a snap-action-plunger or leaf-action miniature switch, generally known as microswitch. An example of such an apparatus is shown in U.S. Pat. No. 3,958,272, issued in the name of Gerhard Rotter et al., and entitled "Turn Around Method and Circuit". The micro-switches (referred to as 17 and 18) are used in a tape transport apparatus to sense the position of carriages which are movable in the direction of a capstan.

The details of a typical tape transport apparatus are shown in U.S. Pat. No. 4,023,748, issued in the name of D. L. Burdorf et al., and entitled, "Cassette Loading and Tape Tensioning System". The apparatus described therein includes a pair of movable pivot arms, each of which is pivoted at one end and carries a journaled reel of tape at the other end. The reels are urged by a spring force into compressive surface engagement with a capstan, whereby the recording tape is transferred from one reel, past a record/playback head, to the other reel. As the tape is so transfered, the diameters of the reels change accordingly and the pivot arms accomodate the change by pivoting to maintain the outer layer of tape on each reel in contact with the capstan. The movement of the pivot arms towards the capstan can be precisely used to determine the diameter of tape on the reel and be correlated to sense the end of tape of the respective reel by the engagement of the pivot arms into a suitable switch.

A problem with prior art switches for tape turn around in video recorder apparatus is the variation in actuation position of the switch. In some arrangements, the pivot arms can be extended beyond the hub of the reel to contact a micro-switch, and thereby magnify the travel of the arm and magnify the sensitivity of the actuation of the switch relative to the diameter of the hub. However, a particular problem exists due to confinement and interference of components which requires that the switch be located between the pivot point and the hub of the lever arm which thereby diminishes the travel of the member and decreases the sensitivity of the switch relative to the diameter of the hub. On a tape system driven at 4 meters per second, any variability in actuation creates a significant range of tape travel that must be monitored in order to precisely locate the point of turn around for the system. A magnifying lever arm arrangement may have been acceptable to operate with a switch having an actuation precision of ±0.001 inches; however, a confined lever arm arrangement may require a switch having an actuation precision of ±0.00025 inches for the same sensing performance. Heretofore, no such precision switch was commercially available.

Another problem with tape turn around switches is that upon engagement of the carriage with the switch, the carriage continues pivoting on its axis until the circuitry actually changes direction on the tape. This overtravel has normally been absorbed by elastically mounting the switch. Elastic mounting of the switch usually contributes to variability in the actuation of the switch. The overtravel requirement of the switch has also been attempted to be solved by using an elastic actuator such as a freely deflectable conductive spring. However, a problem is created in that the engagement force is not always sufficient for electrical conduction and results in variability of the actuation position of the switch. This problem is particularly acute where the switch is controlling a circuit having low current of approximately 2 milliamps at 5 volts such as in the video tape recording example.

Still another problem with switches of the prior art is that the calibration and adjustment is difficult and the entire switch must be repositioned to adjust the actuation position to correspond with the engagement of the member of the apparatus.

SUMMARY OF THE INVENTION

Accordingly, it is an object of the present invention to provide a switch having an elastic actuator which positively engages a pair of electrical contacts.

Another object is to provide a switch that can be precisely adjusted to actuate at a predetermined position of an engaging member.

Another object is to provide a switch for accurately sensing a position of a tape reel carriage.

Another object is to provide a switch for positively and accurately indicating the end of tape on a tape reel.

Still a further object of the present invention is to provide a switch arrangement for alternately indicating the end of tape on a pair of reversing tape reels.

The invention is directed to an electrical switch for use in a system for sensing the end of tape on a reversible tape transport apparatus. The tape transport apparatus has two reels which alternately serve as supply and take up reel on shafts rotatably mounted on pivoted carriage members. The carriage members are biased to urge the tape toward and away from a rotatably driven capstan. The electrical switches are mounted adjacent to each carriage member corresponding to the end of tape on the reel supported thereon. The system includes circuitry for alternately monitoring each switch to facilitate reversing the tape in response to the actuation of the respective switch, followed by signals on the tape which indicate the precise point to reverse the tape and simultaneously advance a transducer head to the next track of the tape.

Each switch is generally contained within a housing having a longitudinal axis. A pair of electrical contacts each interconnected to the circuitry of the system, are positioned within the housing adjacent to the axis. A plunger is adapted to be operable along the longitudinal axis between the two contacts and has one end extending from the housing to act as an actuator. A yoke has a base threadedly secured to the plunger and has a body extending parallel with the plunger within the housing. An elastic shorting means is partially compressed and positioned within the body of the yoke. The elastic shorting mean is adapted to engage the electrical contacts to conduct electricity through the switch. A biasing means such as a compression spring is used to urge the elastic shorting means away from the electrical contacts whereby the switch will be actuated by the position of the plunger which corresponds to a desired position of the respective carriage member.

An important feature of the switch is that the partially compressed elastic member, such as a conductive compression spring, requires a predetermined force for further deflection and thereby assures good conductance upon initial engagement with the electrical contacts.

Another feature of the switch is that it permits overrun of the plunger after intial contact with the pivotal carriage member. The yoke is designed so it does not interfere with the electrical contacts and permits the plunger to further translate into the switch by compressing the elastic shorting means while maintaining good electrical contact without movement or damage to the switch.

Another feature of the switch is that the threaded engagement of the plunger with the base of the yoke permits the plunger length extending from the housing to be readily and accurately adjusted to a length corresponding to a precise engagement by the carriage member.

BRIEF DESCRIPTION OF THE DRAWINGS

While the novel features of the invention are set forth with particularity in the appended claims, the invention will be better understood along with other features thereof, from the following detailed description, taken in conjunction with the drawings, in which;

DESCRIPTION OF THE PREFERRED EMBODIMENT

Figure 1:
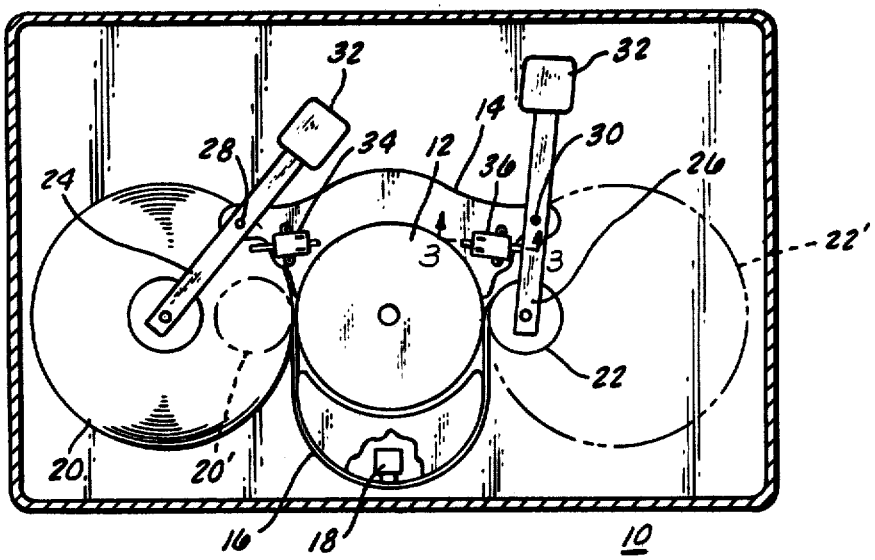
FIG. 1 is a plan view of a video recorder incorporating the switch of the present invention.

Referring first to FIG. 1, there is shown a magnetic recording tape transport which serves as a good example of an apparatus incorporating the present invention. The apparatus 10 is shown having a cylindrical capstan 12 that is mounted for rotation on the chassis 14 and is operative to drive a magnetic tape 16 passed a record/playback transducer head 18. A supply reel 20 and a take-up reel 22, which are arranged in a generally coplanar relationship with the capstan, are driven by surface engagement of each reel's outermost layer of magnetic tape with the capstan. The supply reel 20 is journaled in a first pivot arm carriage member 24, and take up reel 22 is similarly journaled into a second pivot arm carriage member 26. The journaled reels are urged into compressive engagement with the capstan 12 by a spring (not shown) that interconnects in the respective carriage members. The first carriage member 24 is pivotally mounted to chassis 14 at pivot point 28, and similarly second carriage member 26 is mounted to the chassis at pivot point 30. Both carriage members 24 and 26 carry a counterweight 32 to counterbalance the weight of their respective tape reels 20 and 22.

It will be apparent that, when the tape 16 from supply reel 20 is driven past the record/playback head 18 to the take up reel 22, the diameters of the respective reels will vary. The carriage members 24 and 26 accommodate the reel diameter variations by pivoting freely on their respective mountings 28 and 30, moving the respective reels toward and away from the capstan. The alternate extreme diameters of each reel is shown as a dashed cylinder indicated respectively as 20' and 22'. The position of the carriage members correspond with the diameters of the reels and precisely indicate the length of tape on each reel.

Video tape recording systems, more recently developed, utilize an 8 mm wide magnetic tape and record the video signal longitudinally on the tape in multiple tracks of 50 or more across the width of the tape. These tape recording systems drive the tape at speeds in the range of 4 meters per second, and they require the tape to be stopped at the end of each track and driven in opposite direction while simultaneously changing from one track to another. Therefore it is necessary that turn around of these tapes from one direction to the opposite direction be achieved while at the same time assuring that the total distance travelled in changing directions is the same for all tape recording machines.

In accordance with the present invention, a first precision actuation switch 34 is positioned on chassis 14 adjacent to first carriage member 24. Similarly a second switch 36 is positioned adjacent to second carriage member 26. The first switch 34 is positioned so that as the first carriage member 24 pivots towards the capstan 12, as the diameter of the reel 20 decreases, the member 24 will engage the switch as the end of tape approaches the hub of reel 20. Similarily, second switch 36 is positioned so that second member 26 will engage the switch as the end of tape approaches the hub reel 22. Each switch will alternately be engaged by its respective carriage member during the recording and playback of the system along the multiple tracks of the tape.

The system utilizes circuitry described in detail in the aforementioned U.S. Pat. No. 3,958,272, issued in the name of Rotter et al., entitled "Turn Around Method and Circuit" which is assigned to the assignee of the present invention and is incorporated herein by reference. During recording, the system relies highly on the precision of the engagement of the switches 34 and 36. As the system records each track on the tape, the end of tape is indicated by the actuation of the respective switch. Upon actuation of the respective switch, the system delays approximately 1.5 the direction of tape and advance the transducer head 18 at the precise location of recording turn around on the tape.

Figure 4:
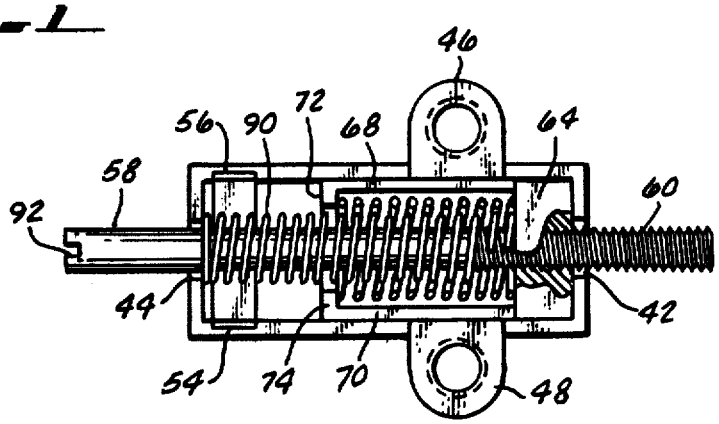
FIG. 4 is a sectional view taken along line 4—4 of FIG. 3.
Figure 3:
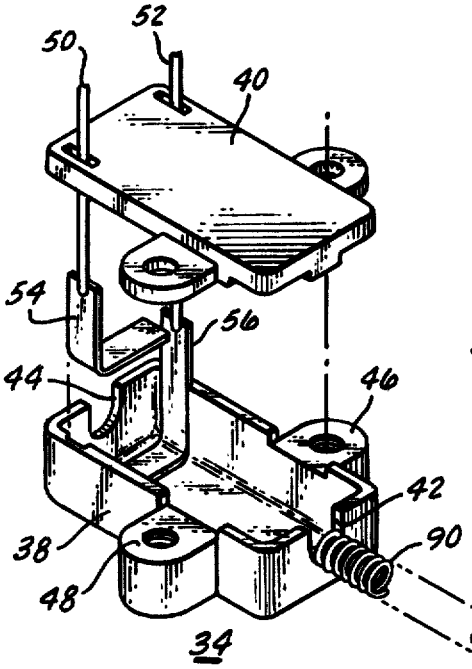
FIG. 3 is a sectional view taken along line 3—3 of FIG. 1 showing the operation of the switch.
Figure 3:
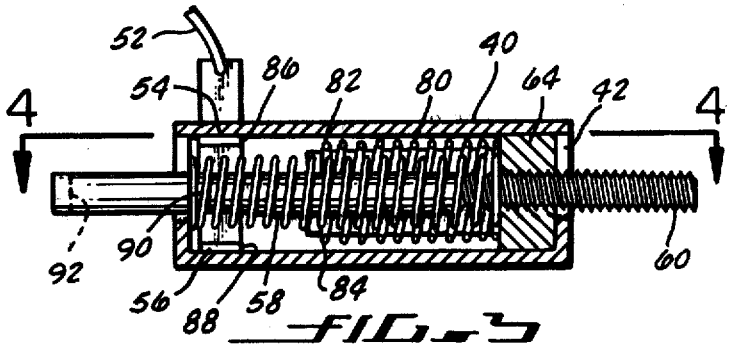
Figure 2:
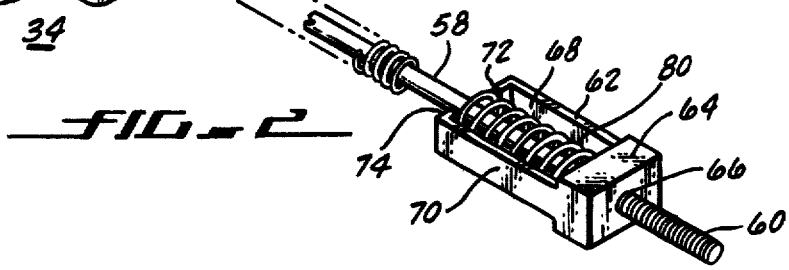
FIG. 2 is an exploded perspective view of the switch shown in FIG. 1.

Referring now to FIGS. 2, 3, and 4, the details of the switch can be fully described. The switch is generally contained within a rectangular dielectric housing 38. The housing has a cover 40 which is secured after assembly of the internal components. The housing has a generally longitudinal axis with a forward aperture 42 and a rearward aperture 44 coincident with the axis. The housing includes mounting flanges 46 and 48 for securing the switch to the chassis 14 by suitable fasteners. The housing can be fabricated from a suitable material such as polycarbonate resin.

The circuitry, represented by wires 50 and 52, is controlled by the switch through electrical contacts 54 and 56. The electrical contacts are positioned within the housing so that the edges of the conductive surfaces are positioned parallel to each other and adjacent to the longitudinal axis of the housing. The contacts can be readily engaged when positioned on opposite sides of the axis, and are shown with contact 54 along the cover and contact 56 along the lower inner surface of the housing. The contacts 54 and 56 are generally shown as "L" terminals extending upward through the cover 40 and having their vertical positions recessed into the sides of the housing. However, any suitably shaped contact materials can be utilized for interconnecting the circuitry of the system. The contacts 54 and 56 can be suitably fabricated from a phospher-bronzematerial having a gold over nickel plating to provide good electrical conductance. A plunger 58 is positioned within the forward aperture 42 and the rearward aperture 44 and adapted to operate along the longitudinal axis between the electrical contacts 54 and 56, within housing 38. The plunger 58 has a threaded end 60 extending from the housing and acts as the actuator for the switch. The plunger 58 can be fabricated from a suitable material such as acetal.

A yoke 62 has a base 64 with a threaded aperture 66 adapted to engage the threaded end 60 of plunger 58. The yoke 62 has narrow arms 68 and 70 extending parallel within the plunger with retaining fingers 72 and 74 at the ends thereof.

A conductive compression spring 80 acts as an elastic shorting means for the switch. The spring is positioned concentrically over the plunger 58 and is retained between the base 64 and the retaining fingers 72 and 74 of yoke 62. The narrow arms and retaining fingers of the yoke permit an upper portion of the end coil 82 and a lower portion of the end coil 84 of the spring 80 to be engageable with an inner edge 86 of contact 54 and an inner edge 88 of contact 56, to operate the switch. The plunger 58, yoke 62 and conductive spring 80 constitute an actuator assembly which is translatable within the housing into abuttment with the contacts 54 and 56.

An important feature of the invention is the manner in which the conductive spring 80 is contained within the yoke 62 of the actuator assembly. In order to absorb the over travel of the plunger after engagement, (approximately 0.040 inches as required in the tape turn around application) an elastic shorting means was used and specifically the aforementioned conductive compression spring 80. It was recognized that spring forces are generally linear and start at $\phi$ load for a free length spring and increase directly with the deflection in accordance with the spring rate of the specific spring. It was determined, for the shape and engaged areas of the contacts, that a force of at least 15 grams was necessary to assure good electrical conductance between the shorting means and the electrical contacts. Therefore, the spring and yoke were designed so that the spring would be retained in a precompressed condition so that a force of 30 grams would be required to further compress the spring and thereby assure good electrical engagement and still allow for over travel of the plunger. Also, the free length of a quantity of compression springs can vary slightly in manufacturing and the preloading of the spring within the yoke tends to consistently and precisely fix the operating length of the installed spring. A suitable conductive compression spring can be fabricated from music wire of 0.010 inch diameter and having an appropriate spring diameter of 0.200 inches to fit within the housing. A suitable free length of 0.560 inches with a spring rate of 0.66 pounds (300 per gram) per inch, which is precompressed within the yoke by 0.10 inches (by appropriately designing the length of the narrow arms 68 and 70) results in the desired preloading of 30 grams. The music wire is plated with gold over nickel to assure good electrical contact. In this example it is necessary to minimize the operative forces of the switch so that it does not alter the loading of the pivot arm; however, in other applications it may be desirable to have a spring with a much higher spring rate. It should also be recognized that a variety of spring materials and dimensions can be arranged to result in the desired preloaded elastic shorting means. This will include a composite of conductive materials and cellular plastic or rubber elastic materials which can be arranged to engage the contacts with the appropriate conductive forces and allow for overtravel by the plunger.

A small diameter compression spring 90 is installed concentrically with the plunger as a suitable biasing means to urge the conductive spring 80 of the actuator assembly away from the contacts 54 and 56. Compression spring 90 is interposed between the rearward aperture 44 of the housing 38 and the base 64 of the yoke to urge the actuator assembly against the forward aperture 42 of the housing. A variety of cellular plastic or rubber material could be utilized as a biasing means.

A screwdriver slot 92 is provided in the opposite end of plunger 58 to facilitate rotation of the threaded extended end 60 within base 64 to precisely calibrate and adjust the length of the actuator to correspond with the desired engagement position of the respective carriage member.

From the foregoing description it should be apparent that the present invention provides a switch having an elastic contact which positively engages, and is readily adjustable to consistently and precisely sense the position of the carriage member to indicate the end of tape of a tape reel. The switch can be installed in pairs to alternately indicate the end of each track on a multitracked video tape recording apparatus.

While a specific embodiment of the present invention has been illustrated and described herein, it is realized that modification and changes will occur to those skilled in the art. It is, therefore, to be understood that the appended claims are intended to cover all such modifications and changes as fall within the true spirit and scope of the invention.

What is claimed:

1. An electrical switch which is mountable adjacent to a movable member for sensing a desired position of the member, comprising:

a housing having a longitudinal axis;

a pair of electrical contacts positioned within said housing adjacent to the axis and adapted to be connected to circuitry means;

an actuator means adapted to be operable along the axis between said contacts, said actuator means including a plunger having one end extending from said housing, and a yoke having a base secured to said plunger and having a body extending parallel with said plunger within said housing;

a shorting means positioned within said housing and adapted to be elastically compressible relative to said actuator means and to be translatable by said actuator means to engage said electrical contacts, said shorting means including a conductive compression spring adapted to be positioned having the free length thereof partially compressed within said yoke body, whereby a predetermined force will be required to further compress said spring to facilitate positive electrical conduction upon abuttment with said electrical contacts; and biasing means to urge said shorting means away from said contacts whereby the switch will be actuated by the position of the plunger of said actuator means corresponding to a position of the member.

2. The switch as in claim 1, wherein an additional force of at least 15 grams is required to further compress said spring.

3. A switch, mounted adjacent to a carriage member for sensing the end of tape on a reversible tape transport of the type having a reel which alternately serves as supply and take up reel rotatably mounted on a carriage member which moves toward and away from a rotatably driven capstan, to facilitate reversing direction of the capstan in response to the actuation thereof, said switch, comprising:

a housing having a longitudinal axis;

a pair of electrical contacts positioned within said housing adjacent to the axis and adapted to be connected to circuitry means;

an actuator means adapted to be operable along the axis between said contacts, said actuator means including a plunger having one end extending from said housing and having screw threads extending substantially over its length, and a yoke which has a base with a threaded aperture adapted to receive said plunger whereby the length of said plunger extending from said housing is precisely adjustable by the rotation of said plunger;

a shorting means positioned within said housing and adapted to be elastically compressible relative to said actuator means and to be translatable by said actuator means to engage said electrical contacts, said shorting means including a conductive compression spring adapted to be positioned having the free length thereof partially compressed within said yoke, whereby a predetermined force will be required to further compress said spring to facilitate positive electrical conduction upon abuttment with said electrical contacts; and biasing means to urge said shorting means away from said contacts whereby the switch will be actuated by the position of the plunger of said actuator means corresponding to a position of the member.

4. The switch as in claim 3, wherein a force of approximately 30 grams is required to further compress said spring.

* * * * *